United States Patent [19]

Vorob

[11] 4,067,212

[45] Jan. 10, 1978

[54] DOOR LOCK

[76] Inventor: Arthur Vorob, 40 W. Hampshire Road, Paramus, N.J. 07652

[21] Appl. No.: 698,937

[22] Filed: June 23, 1976

[51] Int. Cl.[2] ..... E05B 59/04; E05B 63/14

[52] U.S. Cl. ..... 70/103; 70/108; 70/113; 70/120; 70/DIG. 63; 292/37

[58] Field of Search ..... 70/102, 103, 108, 110, 70/113, 114, 115, 116, 117, 118, 119, 120, 121, 122, 123, DIG. 63, 107; 292/32, 33, 34, 37

[56] References Cited

U.S. PATENT DOCUMENTS

| | | | |
|---|---|---|---|
| 993,235 | 5/1911 | Friedman | 292/37 |
| 1,097,902 | 5/1914 | Zappile | 70/120 |
| 1,301,979 | 4/1919 | Schonwald | 70/120 X |
| 1,366,706 | 1/1921 | Sohoell | 70/120 X |
| 1,480,181 | 1/1924 | Mueller | 70/118 X |
| 1,607,038 | 11/1926 | Baron | 70/120 X |
| 1,900,503 | 3/1933 | Kemp | 292/33 |
| 1,966,171 | 7/1934 | Holtzman | 70/114 |
| 2,124,758 | 7/1938 | Bates et al. | 70/118 X |
| 2,584,088 | 1/1952 | Floyd | 70/120 |
| 3,964,281 | 6/1976 | Saipman | 70/120 |

FOREIGN PATENT DOCUMENTS

| | | | |
|---|---|---|---|
| 215,622 | 10/1908 | Germany | 70/103 |
| 348,982 | 8/1919 | Germany | 70/114 |
| 447,012 | 5/1936 | United Kingdom | 70/102 |
| 150,064 | 8/1920 | United Kingdom | 292/37 |
| 3,001 of | 1892 | United Kingdom | 70/113 |

*Primary Examiner*—Roy D. Frazier
*Assistant Examiner*—Thomas J. Holko
*Attorney, Agent, or Firm*—Marvin Feldman; S. E. Feldman

[57] ABSTRACT

A two dead bolt door lock is disclosed wherein the bolts are transversely disposed and wherein the bolts are disposed one behind the other in the locked position so as to provide a secure locking mode. When door mounted, and in the locked position, a vertical bolt is disposed on the inside of the door adjacent the jamb and a horizontal bolt is mounted in the jamb. Attempts to jimmy the horizontal bolt in its line of least resistance are frustrated by the presence of the vertically locked bolt acting against the jimmying force. The locks are both operated by a single key actuated cylinder and/or hand knob through a common connection rod with coordinated cam actions. In another embodiment, keys may be employed on both the inside and the outside of the door.

18 Claims, 6 Drawing Figures

DOOR LOCK

This invention relates to door locks and particularly door locks of the dead bolt type which can be locked and unlocked by turning only one knob or key.

Heretofore it was known to mount several locks having latch bolts or dead bolts at various places along the side of a door. Each bolt was generally separately actuated by either a knob or key. Such bolt combinations required persons to perform several locking or unlocking functions. Also the presence of numerous locks in an effort to provide security, presented an aesthetically undesirable appearance.

In Nolin, U.S. Pat. No. 3,910,613, issued Oct. 7, 1975, a combination dead bolt and latch bolt are simultaneously actuated by a key or knob. The bolts in Nolin were both horizontally disposed and reciprocable with the door jamb. Such bolts could be readily circumvented by a crow bar separating the jamb plate from the bolts.

Now there is provided by the present invention, a high security combination two dead bolt lock where in the locked position one bolt is vertically disposed adjacent the jamb on the inside of the door, and the second bolt is horizontally transversely disposed in the jamb in front of the vertical bolt. Both bolts are commonly operated by either a key on the outside and/or a knob on the inside of the door, as well as alternatively another key on the inside of the door.

It is therefore an object of this invention to provide a high security lock wherein two dead bolts are transversely disposed one behind the other in the locked position.

It is another object of this invention to provide a lock as aforesaid in which the two dead bolts are commonly operated by a single actuating means.

It is another object of this invention to provide a lock as aforesaid in which one bolt is vertically disposed on the inside of the door adjacent the jamb and the other bolt is horizontally disposed within the jamb.

It is still a further object of this invention to provide a lock as aforesaid which may be actuated by a single rotating action or either the inside or outside of the door.

It is still a further object of this invention to provide a lock as aforesaid which may be actuated by a knob on the inside of the door and which readily provides the user with an indication of whether the door is locked or unlocked when viewed from a distance.

Another object of this invention is to provide a lock as aforesaid which is safe and practical in use and yet is readily fabricated and of readily inexpensive construction, while being aesthetically acceptable when door mounted.

Further objects and advantages of the present invention will become apparent from the following description and the accompanying drawings which illustrate certain preferred embodiments and wherein.

Figure 1:
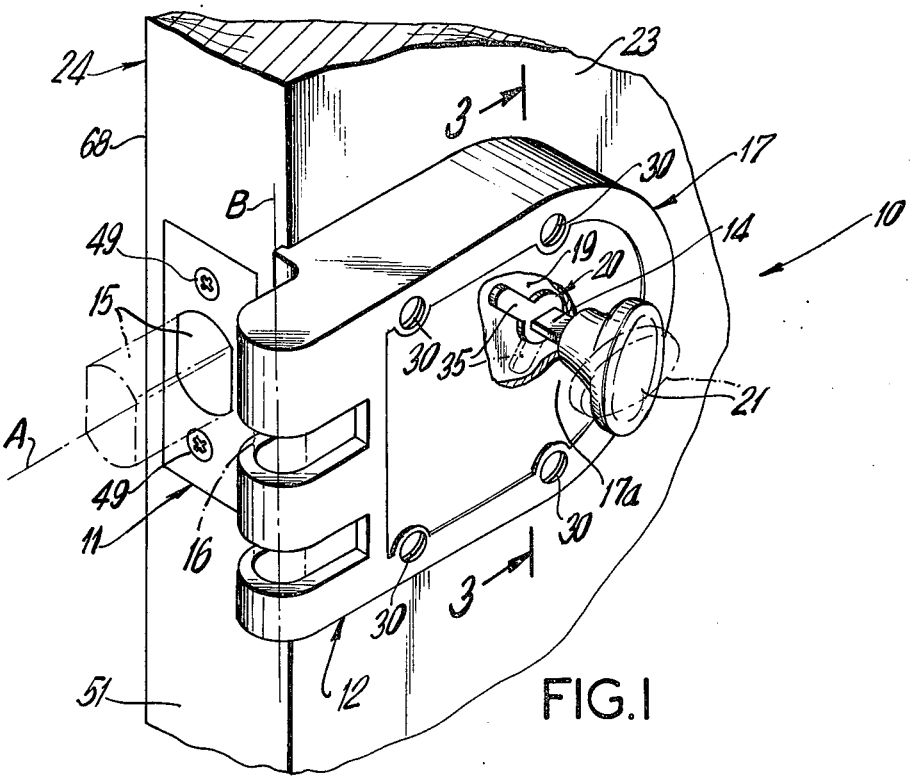
FIG. 1 is a rear perspective and partial fragmentary view of the lock of the present invention.
Figure 3:
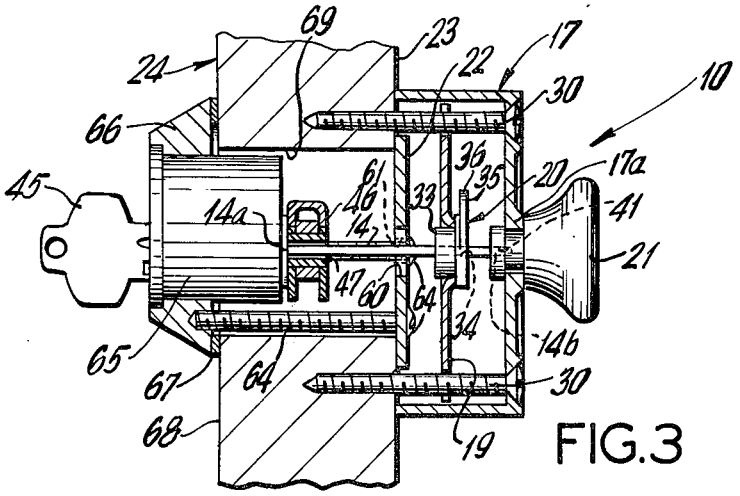
FIG. 3 is a sectional view taken along line 3—3 of FIG. 1.
Figure 4:
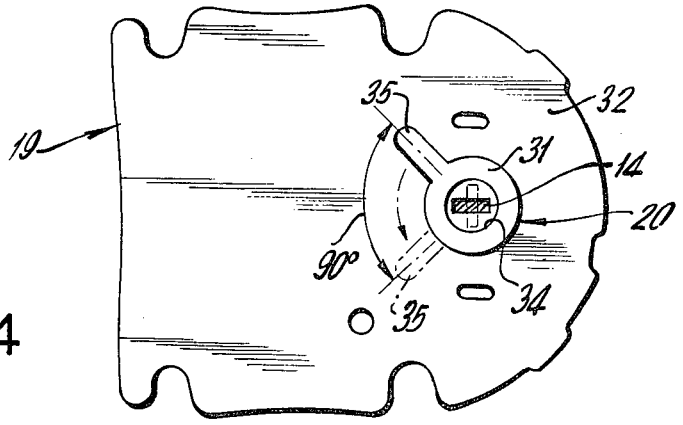
FIG. 4 is a rear elevational view of the cam mounting plate of the lock of FIG. 1.
Figure 2:
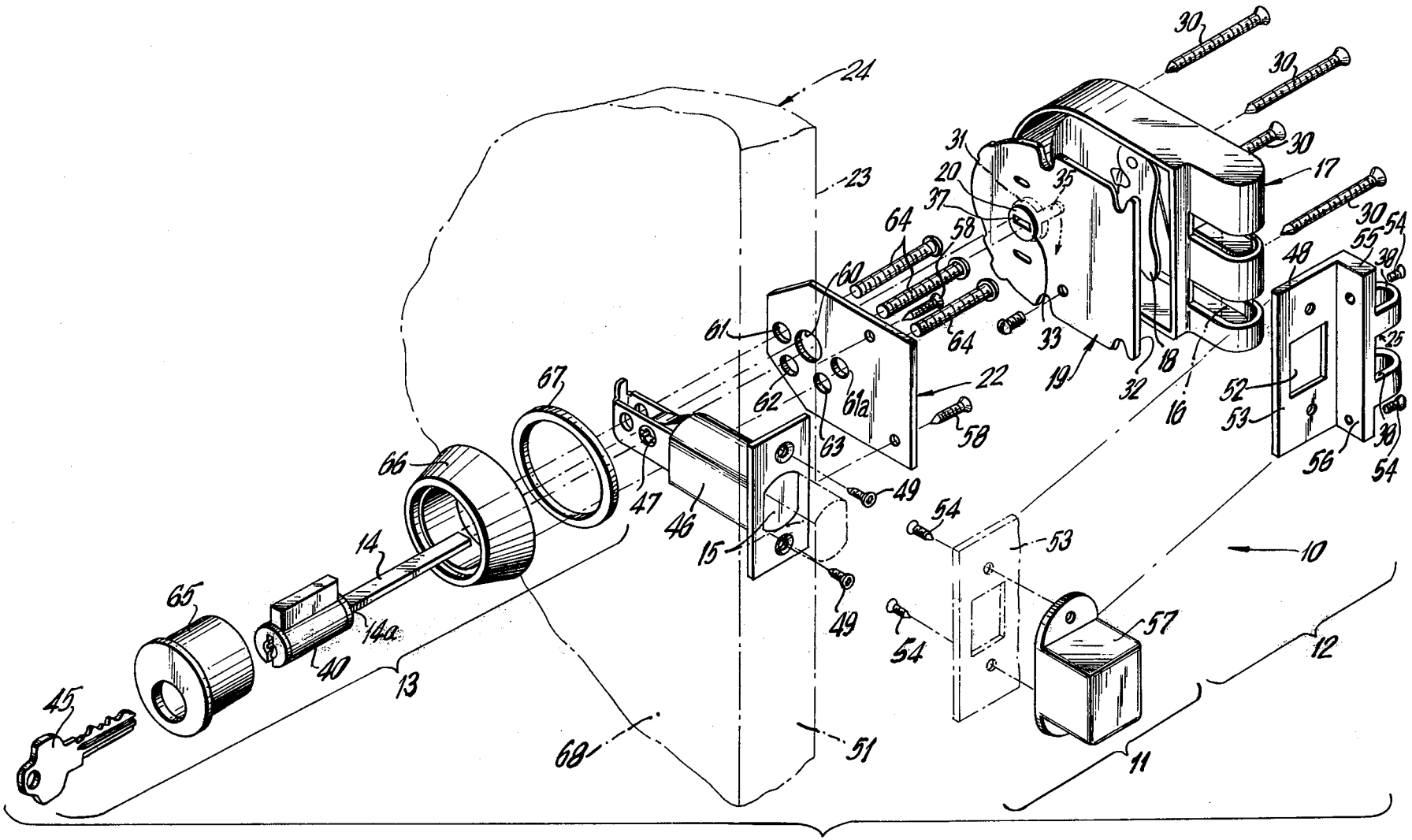
FIG. 2 is an exploded view of the lock of this invention.

Referring to FIGS. 1-4 there is shown the lock of the present invention generally designated as 10. Lock 10 in a broad aspect comprises a horizontal dead bolt assembly 11, a vertical dead bolt assembly 12, a key actuated cylinder assembly 13 having a torque bar 14 which operably interconnects elements of assemblies 11 and 12. The horizontal dead bolt 15 of assembly 11 is disposed in front of the vertical dead bolt 16 of assembly 12, and the axis A of horizontal bolt 15 is transversely disposed to axis B of vertical dead bolt 16.

Assembly 12 comprises a housing 17, vertical dead bolt 16 slidable with housing 17, cam-actuated reciprocal slide plate 18, cam plate 19 with cam 20, and actuating knob 21. Knob 21 is rotatably mounted in housing wall 17*a*. The above elements are mounted over mounting plate 22 on the inside surface 23 of door 24 by bolts 30. A strike plate 25 for accomodating both bolts 15 and 16, is mounted to the door jamb (not shown). Elements 17, 16, 18 and 19 are similar in construction to the elements of the well known Segal lock, such as Model No. 666 or 667, New England Lock & Hardware Co., South Norwalk, Conn.

Cam 20 is formed with a first cylindrical body portion 31 which slidably engages surface 32 of plate 19, and a second cylindrical body portion 33 integral with portion 31, and rotatably mounted in hole 34 of cam plate 19. A flange 35 extends radially outwardly from portion 31 and is formed with cam surface 36 for engaging slide plate 18 so as to actuate plate 18 for movement of plate 18 and bolt 16; the latter movement being in the well known manner. Cam 20 is formed with a central longitudinal slot 37 for slidably receiving actuating torque bar 14. A 90° rotation of torque bar 14 causes a 90° rotation of flange 35 (FIG. 4) in turn causing bolt 16 to move from housing 17 into members 38 thereof to effect vertical bolt locking.

One end 14*a* of torque bar 14 is housed in key cylinder 40 to be actuated thereby, and the other end 14*b* of torque bar 14 is housed in slot 41 formed in knob 21 to be actuated thereby. That is, an approximately 90° rotation of either key 45 or knob 21 will cause a 90° rotation of torque bar 14 and in turn locking or unlocking of bolt 16. With bar 14 horizontally disposed, bolt 16 is unlocked and with bar 14 in the vertical position, bolt 16 is locked.

Turning now to horizontal bolt assembly 11, said assembly 11 comprises a latch 46 with horiontal dead bolt 15 slidably mounted therein, and in turn mounted within door 24 by screws 49 on the side 51 of door 24. Latch 46 and dead bolt 15 are similar in design and construction to Arrow Nos. 920, 921 and 940, 941 of Arrow Lock Corporation, Brookyln, N.Y. 11234; and the D-4000 Series of SchlageLock Co., San Francisco, CA. Latch 46 is formed with through hole 47 for receiving torque bar 14, and the aforesaid 90° rotation of torque bar 14 causes the locking and unlocking of horizontal dead bolt 15, by well known cam action.

Strike plae 25 is formed with an el-flange 48 which is formed with a rectilinear hole 52 for slidably receiving bolt 15. Surface 53 of el-flange 48 is mounted against the side of door jamb (not shown) by means of screws 54. Strike plate portion 55 which is formed with members 38, is provided with inside surface 56 which abuts the inside portion of the jamb. A dust box 57 is mounted within the side of the jamb by means of screws 54 in the well known manner.

Mounting plate 22 is mounted to the inside 23 of door 24 by means of screws 58, and plate 22 is formed with a hole 60 for receiving torque bar 14. In this manner, torque bar 14 emanating from cylinder assembly 13, is mounted through hole 47 of latch 46, through mounting plate 22, to cam plate 19 and knob 21. Mounting plate 22 is formed with four holes 61, 61*a*, 62 and 63 for receiving two bolts 64 in holes 61 and 61*a*, and optionally a third bolt in one of the two inner two adjacent holes 62 and 63. Bolts 64 pass through hole 69 in door 24 and mate with the cylinder assembly 13.

Cylinder assembly 13 comprises an actuating key 45, cylinder housing 65, cylinder 40, torque bar 14, guard ring 66 and spacer ring 67, mounted to the outside 68 of door 24 in the well known manner, and similar in design and construction to the D-4000 Series Schlage locks.

In this manner of construction, key 45 may be inserted in lock cylinder 40 and rotated to turn torque bar 14 which in turn simultaneously actuates horizontal bolt 15 and vertical bolt 16 to locked or unlocked position. Torque bar 14 in turn simultaneously causes the 90° rotation of knob 21. Alternatively, lock 10 may be locked from the inside without key 45, by merely rotating knob 21 to the desired position. Unlike conventional Segal knobs which are 180° vertical in both the locked and unlocked positions, the present knob is fully operable in turning only 90°. Further this 90° operation, in contradistinction to the 180°, permits a person on the inside to view the lock at a distance and determine immediately whether the door is locked or unlocked.

Figure 5:
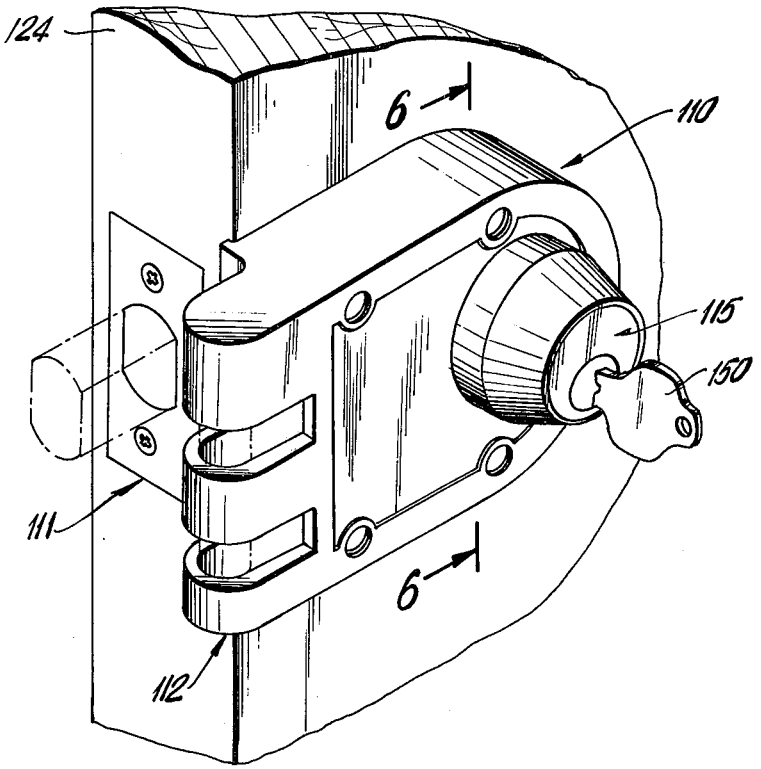
FIG. 5 is a rear perspective view of another embodiment of the present invention.
Figure 6:
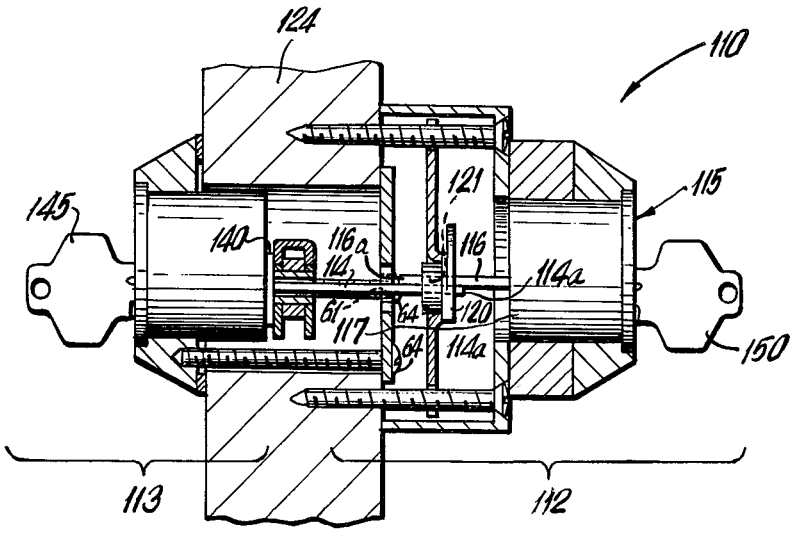
FIG. 6 is a sectional view taken along line 6—6 of FIG. 5.

Referring now to the embodiment of FIGS. 5 and 6, there is shown a lock generally designated as 110. Lock 110 is a double key and cylinder lock. The outside key actuated cylinder assembly 113 of lock 110 is similar to assembly 13 heretofore described except insofar as the present torque bar 114 is shorter than torque bar 14 for purposes hereinafter appearing. Horizontal dead bolt assembly 111 of lock 110 is similar in design and construction to that of assembly 11 heretofore described. Vertical bolt assembly 112 of lock 110 is similar to assembly 12 heretofore described except insofar as a key actuated cylinder assembly 115 replaces knob 21 and a second torque bar 116 is mounted to cylinder 117 of assembly 112.

In this latter embodiment cam 120 is formed with rectilinear hole 121 for receiving the free ends 114*a* and 116*a* of torque bars 114 and 116, respectively, at the same time. In this manner of construction the rotation of either torque bar will cause the simultaneous rotation of the other torque bar. That is, in locking or unlocking the door from the outside, key 145 rotates torque bar 114, and in cam 120 the torque is transmitted to bar 116 (wheter key 150 is present or not). Alternatively, key 145 may be utilized to rotate torque bar 116 and in cam 120 the torque is transmitted to bar 114 and in turn cylinder 140 (whether key 145 is present or not).

Different key and cylinder sets may be employed if desired so that only one key will actuate the door 124 from the inside, and only one key will actuate the door from the outside.

While it is stated that the rotation of the knob is 90°, in an embodiment wherein the horizontal bolt accurately bisects the vertical bolt when viewed along the horizontal, this accurate bisect-mounting results in a rotation of approximately 100° to about 120°. In the embodiment of FIGS. 1-4, the horizontal bolt is mounted slightly lower than the bisection line, and a 90° rotation is sufficient.

In the aforesaid embodiment, the strike plate is shown as serving both bolts but separate accurately mounted strike plates may be employed for each bolt, if desired.

It is also within the contemplation of this invention to provide a lock as aforedescribed in which there is a single actuating means, such as a knob or key mounted to the inside of the door and wherein the front or outside of the door is blank, so that only a person on the inside could actuate the double lock. A person on the outside could only be let in by a person on the inside.

It is also within the contemplation of this invention to utilize other types of bolts such as by way of example, latch bolts, and automatic dead bolts such as the Model DB-9286 of the Ideal Security Hardware Corp., St. Paul, Minn. 55101.

In the aforesaid manner of construction, an attempted jimmying of the locks is frustrated insofar as any application of a side-to-side force is blocked by the presence of the vertical dead bolt, and any application of a front-to-back force is blocked by the presence of the horizontal bolt. That is, a burglar would attempt to jimmy the horizontal strike plate by applying a side-to-side force to move the plate away from the bolt. However with the present construction, the vertically disposed bolt blocks this action. And a burglar would attempt to jimmy a vertical strike plate by applying a front-to-back force in an attempt to strip the vertical strike plate from the back of the jamb. However with the present construction, the horizontally disposed bolt blocks this action. Thusly, the present two coordinated and transversely aligned dead bolts are seen to compliment each other in providing a jimmy-proof lock.

From the foregoing it will be seen that this invention is one well adapted to attain all of the ends and objects hereinabove set forth, together with other advantages which are obvious and which are inherent in the lock.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A lock comprising a first frame portion and a first bold slidable with the first frame portion, a second frame portion and a second bolt slidable with the second frame portion, means for operably interconnecting said bolts, further comprising means to mount said frame portions to a door, and wherein said first bolt is horizontally disposed and said second bolt is vertically disposed when the lock is mounted to the door, said vertically disposed bolt being mountable so as to be disposed on a side of the door, and said vertically disposed bolt having a leading portion to engage a receiving member mounted adjacent the door jamb, and the horizontally disposed bolt being mountable on the door and having a leading portion to slide into a receiving member recessed within the door jamb, said leading portions of said bolts being transversely disposed one directly behind the other and being spaced one behind the other when in the respective receiving members to provide a locked position and means to actuate said interconnecting means being mounted more adjacent one frame portion than the other frame portion whereby the actuating means causes the interconnecting means to slide the leading portions of both bolts from the respective frame portions into the respective receiving members to the locked position.

2. The lock of claim 1, wherein said bolts are dead bolts.

3. The lock of claim 2, wherein said interconnecting means being operably connected to said bolts to cause said bolts to be actuated simultaneously to the locked position.

4. The lock of claim 1, further comprising a second actuating means mounted more adjacent the other frame portion than said one frame portion.

5. The lock of claim 4, wherein said first actuating means is a key and cylinder and wherein said second actuating means is a knob, one end of said interconnecting means being mounted to said cylinder and the other end of said interconnecting means being mounted to said knob.

6. The lock of claim 4, wherein said first and second actuating means are keys with respective cylinders.

7. The lock of claim 6, wherein the first and second keys and cylinders are diferent.

8. The lock of claim 1, said interconnecting means comprising a torque bar being connected to said actuating means and one portion of said torque bar being operably mounted to means to slide one of said bolts and a second portion of said torque bar being operably mounted to means to slide the other of said bolts said first and second portions being spacedly disposed along the torque bar.

9. The lock of claim 8, said actuating means comprising a knob.

10. The lock of claim 9, further comprising a second actuating means mounted adjacent the other frame portion and wherein the other end of the torque bar is connected to said second actuating means.

11. The lock of claim 10, said second actuating means comprising a key and cylinder.

12. The lock of claim 11, said one portion of said torque bar being received in a slot of a cam member rotatably mounted in a plate, and a cam surface extending radially from said member wherein said torque bar rotates said cam member so as to cause sliding said one bolt.

13. The lack of claim 8, said one portion of said torque bar being received in a cam member rotatably mounted in a plate, having a cam surface extending radially from said member wherein said torque bar rotates said member so as to cause sliding said one bolt.

14. The lock of claim 1, wherein the actuating means is rotated about 90°.

15. The lock of claim 1, wherein the actuating means is rotated from about 100° to about 120°.

16. The lock of claim 1, further comprising a strike plate being formed with a first hole to receive said leading portion of first bolt and being formed with a second hole to receive said leading portions of second bolt.

17. The lock of claim 1, wherein the plane defined by the axis of said first bolt intersects the plane defined by the axis of said second bolt.

18. The lock of claim 1, comprising a second actuating means, one actuating means being mounted to the said side being the inside of the door and the other actuating means being mounted to the outside of the door, and wherein one end of said interconnecting means is mounted to one actuating means and the other end of the interconnecting means being mounted to the other actuating means.

* * * * *